US006703612B2

(12) United States Patent
Goembel

(10) Patent No.: US 6,703,612 B2
(45) Date of Patent: Mar. 9, 2004

(54) LARGE GEOMETRIC FACTOR CHARGED PARTICLE SPECTROMETER

(76) Inventor: Luke Goembel, 1020 Regester Ave., Baltimore, MD (US) 21239

( * ) Notice: Subject to any disclaimer, the term of this patent is extended or adjusted under 35 U.S.C. 154(b) by 136 days.

(21) Appl. No.: 09/940,209

(22) Filed: Aug. 28, 2001

(65) Prior Publication Data

US 2003/0042416 A1 Mar. 6, 2003

(51) Int. Cl.[7] ..... H01J 47/00
(52) U.S. Cl. ..... 250/305; 250/307; 250/309
(58) Field of Search ..... 250/305, 396, 250/397, 287, 307, 309

(56) References Cited

U.S. PATENT DOCUMENTS

| | | | | |
|---|---|---|---|---|
| 3,733,483 A | | 5/1973 | Green et al. | |
| 4,255,656 A | * | 3/1981 | Barrie et al. | 250/305 |
| 4,823,003 A | * | 4/1989 | King et al. | 250/305 |
| 5,285,066 A | | 2/1994 | Sekine et al. | |
| 6,104,029 A | | 8/2000 | Coxon et al. | |

OTHER PUBLICATIONS

Gelius et al., A New ESCA Instrument with. . . , *Journal of Electron Spectroscopy and Related Phenomena*, V.52, 1990 pp. 747–785, Elsevier, Netherlands.

Carlson & McFadden, Design and Application of Imaging Plasma Instruments, *Measurement Techniques in Space Plasmas: Particles*, 1998, pp. 125–140, American Geophysical Society, Washington D.C.

Doering et al., The Photoelectron–Spectrometer Experiment on Atmosphere Explorer, *Radio Science*, 1973, pp. 387–392, vol. 8, No. 4 American Geophysical Union, Washington D.C.

Goembel et al., Atmospheric $Oin_2$ Ratios From Photoelectron Spectra, *Journal of Geophysical Research*, 1997, pp. 7411–7419, vol. 102, No. A4, American Geophysical Union, Washington D.C.

David T. Young, Space Plasma Particle Instrumentation and the New Paradigm, Faster, Cheaper, Better, *Measurment Techniques in Space Plasmas; Particles*, 1998, pp. 1–16, American Geophysical Union, Washington D.C.

L. Goembel & J.P. Doering, Instrument for Measuring Spacecraft Potential, *Jounal of Spacecraft & Rockets*, 1998, pp. 66–72, vol. 35, No. 1, American Institute of Aeronautics & Astronautics.

* cited by examiner

*Primary Examiner*—Hai Pham
*Assistant Examiner*—Lam S Nguyen
(74) *Attorney, Agent, or Firm*—George A. Willinghan, III

(57) ABSTRACT

A spectrometer is provided for the energy analysis of charged particles. The spectrometer consists of a hemispherical capacitor energy analyzer, a collimator and entrance aperture that define the solid angle of acceptance and geometric factor of the spectrometer, and a charged particle detector. The entrance aperture and collimator are arranged to maximize the geometric factor of the analyzer while retaining high energy-resolution.

19 Claims, 4 Drawing Sheets

LARGE GEOMETRIC FACTOR CHARGED PARTICLE SPECTROMETER

FIELD OF THE INVENTION

The present invention generally relates to spectroscopy and in particular relates to spectrometers and methods of spectroscopy for the energy analysis of charged particles.

BACKGROUND OF THE INVENTION

Charged particle spectroscopy is a powerful tool in space science. The energy analysis of the ambient charged particles in outer space provides an understanding of geophysical and extraterrestrial phenomena. Charged particle spectroscopy in space generally involves energy analyzing the charged particles that flow from various directions toward the spacecraft. The spectra collected help us understand atmospheric phenomena such as solar photoionization of the earth's upper atmosphere and extraterrestrial phenomena such as changes in the solar wind over the solar cycle. The knowledge gained from such instruments also helps us model conditions in outer space.

Since the flow of charged particles in outer space is generally low, it is of great importance to fly instruments with a large geometric factor in order to collect data as quickly as possible. The geometric factor is proportional to the product of the charged particle energy analyzer's entrance aperture area and its solid angle of acceptance. The sensitivity of the instrument (the rate at which particles are counted for a given ambient particle flux) is proportional to the instrument's geometric factor.

In general, there is an inverse relationship between geometric factor and energy resolution for electrostatic energy analyzers. In practice, slit width is often narrowed to increase energy resolution. By narrowing slit width, geometric factor and sensitivity are reduced due to the decreased area of the entrance aperture. High energy resolution instruments tend to have a low geometric factor and high geometric factor instruments tend to have low energy resolution.

The trend in space science has been to sacrifice energy resolution in favor of geometric factor to compensate for the low particle fluxes in outer space. High geometric factor instruments can energy analyze the ambient charge particles very rapidly—but at relatively low energy resolution. Spectrometers of inherently large geometric factor and low energy resolution now dominate the field, such as those classified as quadraspherical in design. Some details of the quadraspherical (quarter of a sphere), or "top hat", design instruments are described by C. W. Carlson et al. in *Measurement Techniques in Space Plasmas: Particles*, pp. 125–140, 1998.

Although the trend now is to fly compact, large geometric factor, quadraspherical charged particle analyzers, hemispherical electrostatic analyzers have flown in the past to provide very high energy-resolution spectra. Hemispherical electrostatic analyzers are preferred for high energy-resolution work because of their high charged-particle-optical efficiency and their lack of charged-particle-optical aberrations. One such instruments is described by Doering et al. in *Radio Science*, Vol. 8, No. 4, 1973, pp. 387–392, flew on three satellites in the 1970's. The energy resolution of the instrument was 2.5% (change in energy divided by energy, full peak width at half maximum peak height). Charge particle analyzers now used for space flight rarely have energy resolution of better than 5%, and more commonly have energy resolution in the double digits.

There is now interest in collecting high energy-resolution spectra of charged particles in outer space. For instance, the determination of spacecraft floating potential is possible through an analysis of high energy-resolution electron energy spectra, as described in L. Goembel and J. Doering, Journal of Spacecraft and Rockets, Vol. 35, No. 1, pp. 66–72, 1998. It is important to measure spacecraft charge because even minor spacecraft charging biases scientific instruments (such as plasma spectrometers) and makes it difficult to interpret valuable data. In extreme cases rapid discharge from a spacecraft can cause costly system failures. Monitoring the charge and reducing it through a controlled discharge can prevent such damage. Other uses for high energy resolution electron spectra exist, such as in the determination of the ratio of ambient atomic oxygen to nitrogen in the upper atmosphere, as described by L. Goembel and J. P. Doering in Journal of Geophysical Research, Vol. 102, No. A4, pp. 7411–7419, 1997.

To date, there have been no compact, large geometric factor instruments capable of collecting high energy-resolution charged particle spectra in outer space. The high energy-resolution hemispherical analyzer-based instrument described by Doering et al. in Radio Science, Vol. 8, No. 4, pp. 387–392, 1973 would be considered bulky by today's standards. It would also be considered slow to collect spectra by today's standards since its geometric factor was small compared to the quadraspherical spectrometers that are currently in use. Designers of charged particle spectrometers appear to have reached an impasse in efforts to design a compact, high geometric factor, high-energy resolution instrument. Although the fully focusing charged particle optics of the hemispherical condenser design make it the preferred configuration for high energy-resolution spectroscopy, the large hemisphere that would be needed to collect data quickly with a spectrometer of the traditional design rules out the deployment of such an instrument. The accepted rule in the design of space flight charged particle spectrometers has been "if sensor optics are focusing then little can be done to improve performance short of increasing sensor dimensions", as quoted from D. T. Young, "Space Plasma Particle Instrumentation and the New Paradigm: Faster, Cheaper, Better", p.8, Measurement Techniques in Space Plasmas: Particles, R. T. Pfaff, J. E. Borovsky, David T. Young, Editors, (Geophysical Monograph; 102), American Geophysical Union (Washington, D.C. 1998).

Much development of hemispherical charged particle energy analyzers has been done in fields outside of space science. The double-focusing property of the hemispherical analyzer has long been utilized in the field of surface imaging electron spectroscopy (XPS or ESCA). Hemispherical analyzers with extended arcuate slits such as shown in FIG. 6 of U.S. Pat. No. 3,733,483 to Green et al. (1973), FIG. 4a of U.S. Pat. No. 5,285,066 to Sekine et al. (1994), and FIG. 1 of U.S. Pat. No. 6,104,029 to Coxon et al. (2000) have been used to maximize the sensitivity of such instruments. In such imaging spectroscopy, focusing multi-element fore-optics are used to transmit an electron-spectroscopic image of the surface to the entrance plane of the hemispherical analyzer. The resulting image on the detector has one direction representing energy, and the perpendicular direction representing position on the original surface, as described by U. Gelius et al. in J. of Electron Spectroscopy and Related Phenomena Vol. 52, 1990, p. 761.

Traditional hemispherical charged particle analyzers for space flight have contained a circular entrance aperture, such as that of Doering et al. in Radio Science, Vol. 8, No. 4, pp. 387–392, 1973.

SUMMARY OF THE INVENTION

The present invention utilizes an arcuate entrance slit on a charged particle analyzer to retain energy resolution while increasing aperture area, and, thus, geometric factor. Unlike imaging spectrometers that have contained arcuate slits, the present invention does not utilize imaging fore-optics but has an arcuate collimator that defines the solid angle of acceptance of the instrument. The present invention maximizes the solid angle of acceptance of the instrument and maximizes the aperture area of the instrument so that the ambient charged particles can be collected with greatest efficiency. The double focusing property of the hemispherical analyzer is used to maximize the solid angle of acceptance and charged-particle-optical filling of the space between the hemispherical electrodes while retaining the superb energy resolution of the hemispherical design.

The present invention breaks through the perceived impasse in efforts to design a compact high energy-resolution, high geometric-factor charged particle analyzer. The present invention retains the energy resolution of instruments that have flown in the past, but vastly increases geometric factor, by using an arcuate slit for both the collimator and entrance aperture. It is possible to increase the geometric factor by nearly two orders of magnitude over the instrument in Doering et al. with no increase in instrument size. Such a dramatic increase in the geometric factor of the instrument with no increase in bulk makes the instrument of the present invention competitive with similarly sized space science instruments of quadraspheric or other lower resolution design. This invention makes it possible to collect the quality data needed to determine, for example spacecraft floating potential, with a compact instrument and with high temporal resolution.

The present invention provides a charged particle spectrometer with a large geometric factor and high energy resolution that is capable of obtaining charged particle spectra of the environment under investigation in a relatively short period of time.

The above object is achieved by a charged particle spectrometer containing a coaxial hemispherical charged particle energy analyzer having an input slit extending in the direction perpendicular to a radial direction of the hemispherical electrodes included in the energy analyzer, an input collimator for defining the field of view of the spectrometer which is also extending in the direction perpendicular to a radial direction of the hemispherical electrodes included in the energy analyzer and a detector placed at the output end of the hemispherical analyzer that is capable of detecting the charged particles that pass through the hemispherical analyzer.

Other objects and features of the invention will become obvious upon an understanding of the illustrative embodiment about to be described or will be indicated in the appended claims, and various advantages not referred to herein will occur to one skilled in the art upon employment of the invention in practice.

BRIEF DESCRIPTION OF THE DRAWINGS

Examples of embodiments of the present invention will now be described with reference to the drawings, in which.

REFERENCE NUMERALS IN DRAWINGS

Figure 1:
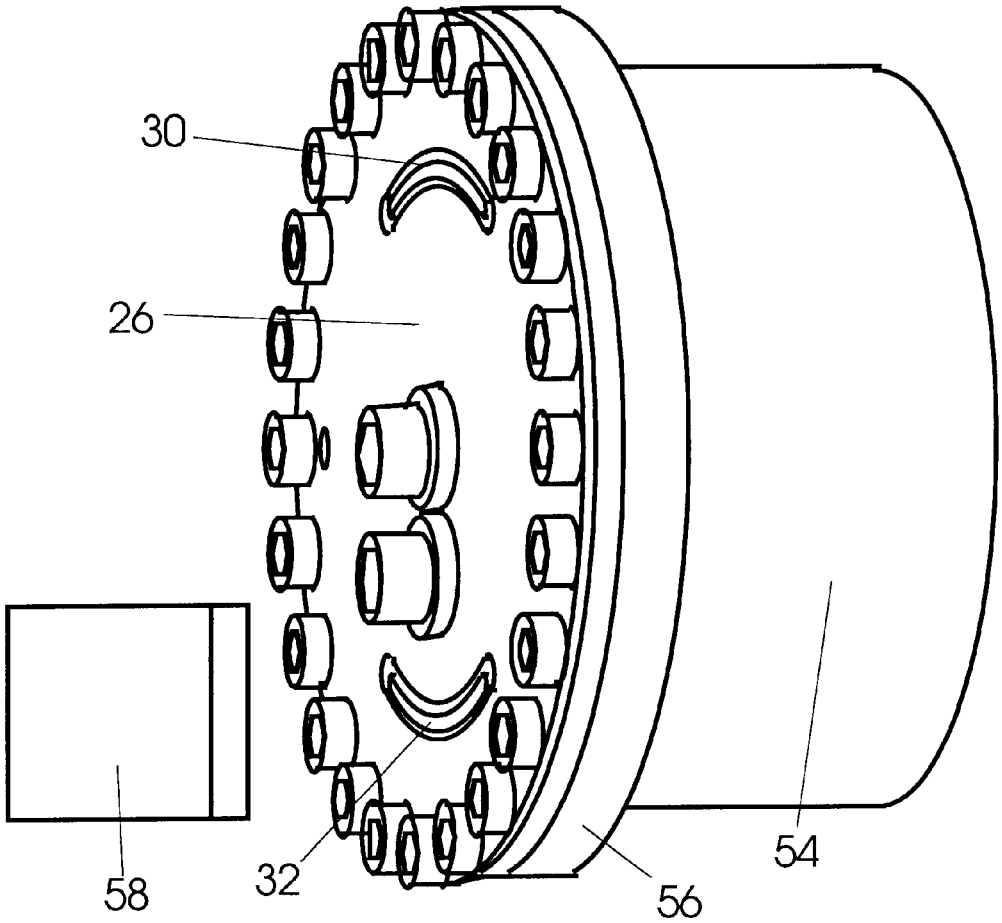
FIG. 1 is an isometric view of the assembled invention.

The following reference numerals appear in the drawings:

| | |
|---|---|
| 20 | Central Bolt |
| 22 | Offset Bolt |
| 24 | Radial Bolt |
| 26 | Magnetic Shield Base |
| 28 | Collimator Plate |
| 30 | Entrance Collimator |
| 32 | Exit Collimator |
| 34 | Base Plate |
| 36 | Aperture Plate |
| 38 | Entrance Aperture |
| 40 | Exit Aperture |
| 42 | Alignment Ring |
| 44 | Offset Alignment Peg |
| 46 | Central Alignment Peg |
| 48 | Inner Hemispherical Electrode |
| 50 | Outer Hemispherical Electrode |
| 52 | Spacer |
| 54 | Magnetic Shield |
| 56 | Bolt Ring |
| 58 | Charged Particle Detector |
| 60 | Spectrometer Solid Angle of Acceptance |
| 62 | Trajectory of Particle through Spectrometer |

DETAILED DESCRIPTION OF THE INVENTION

Figure 2:
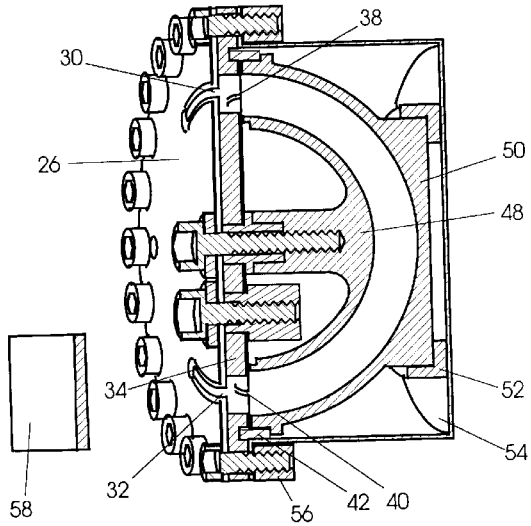
FIG. 2 is a sectional isometric view of the assembled invention.
Figure 3:
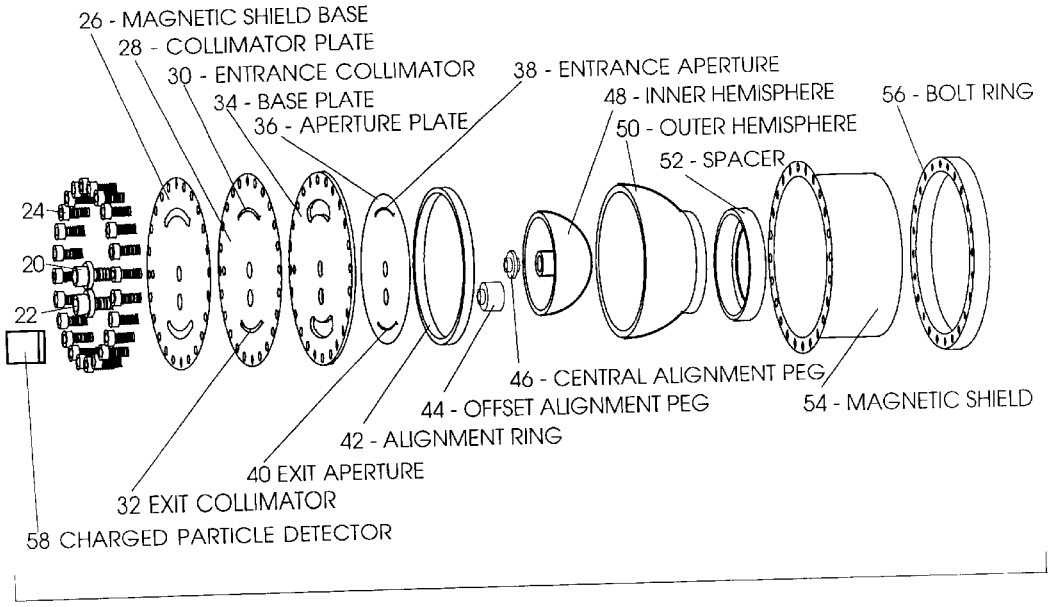
FIG. 3 is an exploded view of the invention with parts labeled.

Referring to FIGS. 1, 2, and 3, in which the same reference numerals are used to designate like parts, the preferred embodiment of the charged particle analyzer or spectrometer in accordance with the present invention is illustrated. The analyzer includes a pre-energy analysis entrance collimator 30, an entrance aperture 38, an inner hemispherical electrode 48 and a coaxial or concentric outer hemispherical electrode 50. The base of hemispheres 48 and 50 define the plane of focus for the analyzer, approximately the location of an aperture plate 36. The center of aperture plate 36 therefore defines the spherical center of the charged particle analyzer. A base plate 34 separates a collimator plate 28 from aperture plate 36. Aperture plate 36 contains entrance aperture 38 and an exit aperture 40. Collimator plate 28 contains entrance collimator 30 and an exit collimator 32. A magnetic shield base 26, collimator plate 28, base plate 34, aperture plate 36, and inner hemisphere 48 are held together with a central bolt 20 and a central alignment peg 46. The collimators 30 and 32, apertures 38 and 40, openings in magnetic shield base 26, and base plate 34 are held in alignment by an offset alignment peg 44 and an offset bolt 22. Outer hemisphere 50 is aligned with inner hemisphere 48 by use of an alignment ring 42 that centers outer hemisphere 50 in a magnetic shield 54. Multiple radial bolts 24 attach a bolt ring 56, magnetic shield 54, a spacer 52, outer hemisphere 50, and alignment ring 42 to magnetic shield base 26, collimator plate 28, base plate 34, aperture plate 36, and inner hemisphere 48. A charged particle detector 58 is located at the output end of the spectrometer as shown in FIGS. 1, 2 and 6.

All of the parts of this embodiment of the inventions are constructed from conductive metal with the exception of 42, 44, 46, 52, and 58. Parts 42, 44, 46, and 52 are constructed of a non-conducting plastic to electrically isolate the conductive parts they separate. Charged particle detector 58 is constructed from a combination of conducting and non-conducting materials. Magnetically shielding parts 26 and 54 are constructed from 80% permeability mu-metal sheet. Collimator and aperture plates 28 and 36 are constructed from molybdenum sheet in this embodiment of the invention.

Figure 4:
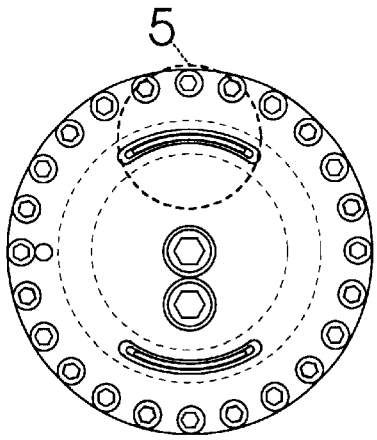
FIG. 4 is a front view of the invention with detector absent.
Figure 5:
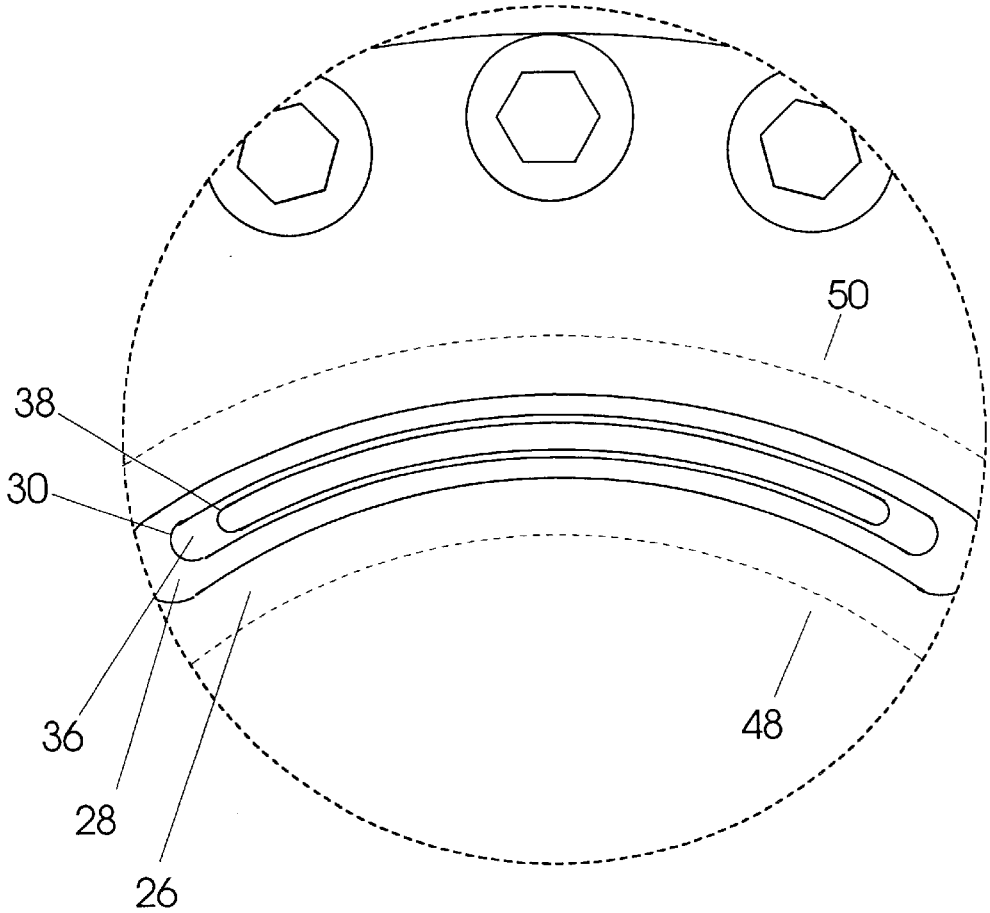
FIG. 5 is an enlarged detail of the area marked in FIG. 4.

FIGS. 4 and 5 illustrate the arrangement of entrance aperture 38 and entrance collimator 30. FIG. 4 is a front view of the preferred embodiment of the invention with detector 58 absent and FIG. 5 is an enlarged view of the circular area marked in FIG. 4. A hemispherical energy analyzer contains two concentric hemispherical electrodes 48 and 50 defining a hemispherical space between. Entrance aperture 38 is in the shape of an arcuate slit whose center of curvature coincides with the spherical center of coaxial or concentric hemispherical electrodes 48 and 50, with the slit lying on a circle whose radius is substantially midway between inner and outer hemispherical electrodes 48 and 50. Entrance aperture 38 in this embodiment of the invention extends in an arc by 60 degrees. Collimator plate 28 lies in a plane parallel to, but some distance from, aperture plate 36. In the preferred embodiment of the invention illustrated in FIGS. 1–5, collimator plate 28 is separated from aperture plate 36 by a distance that is equal to approximately 15% of the radius of inner hemisphere 48. Collimator plate 28 contains entrance collimator 30, an arcuate slit whose center of curvature coincides with the spherical center of coaxial hemispherical electrodes 48 and 50, with the slit lying on a circle whose radius is substantially midway between inner and outer hemispherical electrodes 48 and 50. Entrance collimator 30 in this embodiment of the invention is an arc that extends somewhat more than 60 degrees and is somewhat wider in the radial direction than entrance aperture 38, as illustrated in FIG. 5. It is the combination of entrance collimator 30 and entrance aperture 38 that defines the solid angle of acceptance of the spectrometer.

Figure 6:
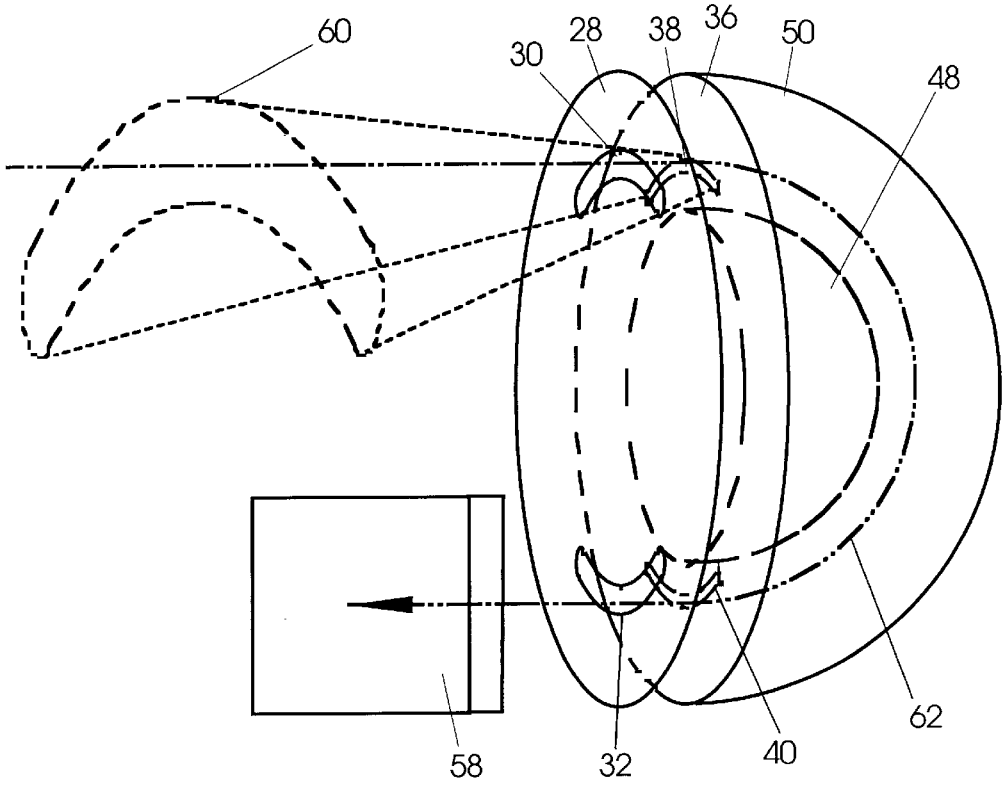
FIG. 6 is a schematic drawing of the solid angle of acceptance of the spectrometer as defined by the input collimator and slit.

FIG. 6 is provided to illustrate the function of the preferred embodiment of the invention and is not drawn to scale. Some shapes have been simplified and some distances have been exaggerated for clarity. A voltage is applied between hemispherical electrodes 48 and 50. Aperture plate 36 and collimator plate 28 are electrically isolated from hemispherical electrodes 48 and 50. Entrance collimator 30 restricts the angle of acceptance into entrance aperture 38. The dotted outline to the left of entrance collimator 30 approximates the solid angle of acceptance 60 of this embodiment of the spectrometer. A trajectory of a charged particle through the spectrometer 62 appears as a dashed line. The electrostatic potentials of surfaces 28, 36, 48, and 50 are set to pass a particle with trajectory 62. A charged particle enters the spectrometer through entrance collimator 30 and entrance aperture 38 and follows a semicircular path with its center of radius at the hemispherical center of the instrument. The particle is then free to pass through exit aperture 40 and exit collimator 32 and continue to charged particle detector 58. If a particle has more or less energy than the band-pass of the spectrometer it will not strike detector 58. If the particle does not enter the spectrometer solid angle of acceptance 60 it will not pass through the analyzer and strike detector 58. Thus charged particle detector 58 will only detect charged particles of the band of energies selected by setting the electrostatic voltages of collimator plate 28, aperture plate 36, inner hemisphere 48, and outer hemisphere 50 to electrostatic potentials known to those skilled in the art of hemispherical electrostatic charged particle energy analysis. The invention will also only detect particles that enter the spectrometer through its solid angle of acceptance 60 as defined by entrance collimator 30 and entrance aperture 38. Exit collimator 32 serves to reduce the spectrometer noise due to scattered secondary charged particles produced within the space between inner hemisphere 48 and outer hemisphere 50 in this embodiment of the invention. Exit aperture 40 serves to narrow the energies of charged particles that are allowed to reach the detector in this embodiment of the invention.

Thus, the reader will see that the invention provides for a hemispherical charged particle energy spectrometer with a larger aperture area than that with a circular entrance aperture and provides for a large solid angle of acceptance in order to have a large geometric factor. The invention will reduce the time needed to gather a charged particle energy spectrum at a given ambient flux. The invention will be especially important in the field of space science instrumentation where high-speed data collection with compact, light weight instruments is needed.

The above description is not intended to limit the scope of the present invention, but rather is an exemplification of an embodiment thereof. Many other variations are possible that are within the scope of the present invention and produce the unexpected results and advantages thereof, For examples in another embodiment exit collimator 32 can be eliminated and the analyzer retains its functionality. Likewise, exit aperture 40 can be replaced with a position sensitive charged particle detector to retain energy resolution with the added advantage of multiple channels of energy detection at a single setting of electrostatic potentials at surfaces 28, 36, 48, and 50. The section of arc of collimators 30 and 32 and apertures 38 and 40 could be less, or more, than the 60° in the preferred embodiment of the invention and the advantages of this invention would be retained. In another embodiment, inner hemisphere 48 and outer hemisphere 50 can be very nearly hemispherical. In yet another embodiment, arcuate entrance collimator 30 could have a shape that very nearly, rather than exactly, follows an arc.

Having thus described my invention with the detail and particularity required by the patent laws, what is claimed to be protected by Letters Patent is set forth in the following claims:

I claim:

1. A charged particle spectrometer comprising:

a. concentric substantially hemispherical electrodes for analyzing energies of charged particles;

b. a curved entrance collimator arranged to define the field of view of the spectrometer, said entrance collimator a substantially arcuate slit having a center of curvature coinciding substantially with a spherical center of said concentric hemispherical electrodes, with said slit lying substantially on a circle whose radius is substantially midway between said coaxial hemispherical electrodes;

c. a curved entrance aperture spaced from the entrance collimator and arranged to admit the charged particles into the spectrometer said entrance aperture a substantially arcuate slit whose center of curvature coincides substantially with the spherical center of said concentric hemispherical electrodes, with the slit lying substantially on a circle whose radius is substantially midway between said coaxial hemispherical electrodes; and d. a detector for detecting the charged particles admitted through the entrance aperture;

wherein said analyzer, entrance collimator, entrance aperture, and detector are arranged to provide a large solid angle of acceptance.

2. The charged particle spectrometer of claim 1, further comprising an exit aperture, said exit aperture comprising a substantially arcuate slit whose center of curvature coincides substantially with the spherical center of said concentric hemispherical electrodes and lying substantially on a circle whose radius is substantially midway between said coaxial hemispherical electrodes.

3. The charged particle spectrometer of claim 1, further comprising an exit collimator, said exit collimator comprising a substantially arcuate slit whose center of curvature coincides substantially with the spherical center of said concentric hemispherical electrodes, and lying substantially on a circle whose radius is substantially midway between said concentric hemispherical electrodes.

4. The charged particle spectrometer of claim 1, wherein the detector comprises a position sensitive multi-channel charged particle detector to provide for the simultaneous detection of charged particles having varying energies.

5. A charged particle energy analyzer comprising:

two electrodes arranged to define a space between the electrodes for passing particles having selected energies;

an aperture plate spaced from the electrodes and comprising an entrance aperture arranged to admit particles into the space between the electrodes wherein the entrance aperture comprises an arcuate slit; and a collimator plate spaced from the aperture plate such that the aperture plate is disposed between the collimator plate and the electrodes, the collimator plate comprising an entrance collimator arranged to define an angle of acceptance into the entrance aperture;

wherein the entrance aperture and entrance collimator define a solid angle of acceptance of the analyzer and the analyzer is capable of analyzing particles entering the space between the electrodes through the solid angle of acceptance.

6. The analyzer of claim 5, wherein the entrance aperture arcuate slit comprises an arc of 60 degrees.

7. The analyzer of claim 5, wherein the entrance collimator comprises an arcuate slit.

8. The analyzer of claim 7, wherein the entrance collimator arcuate slit comprises an arc of more than 60 degrees.

9. The analyzer of claim 5, further comprising a charged particle detector arranged to detect the particles passing through the space between the two electrodes.

10. The analyzer of claim 9 wherein the charged particle detector comprises a position sensitive multi-channel detector capable of simultaneously detecting charged particles of varying energies.

11. The analyzer of claim 9, further comprising an output end spaced from the aperture plate such that the charge particles pass through the output end before being detected by the detector; and an exit aperture disposed at the output end and arranged to narrow the energies of the charged particles reaching the detector.

12. The analyzer of claim 11, wherein the exit aperture comprises an arcuate slit.

13. The analyzer of claim 11, wherein the exit aperture is disposed in the aperture plate.

14. The analyzer of claim 9, further comprising an exit collimator disposed at the analyzer exit such that the exit aperture is disposed between the output end and the exit collimator, the exit collimator arranged to reduce noise associated with scattered secondary charged particles.

15. The analyzer of claim 14, wherein the exit collimator comprises an arcuate slit.

16. The analyzer of claim 14, wherein the exit collimator is disposed in the collimator plate.

17. The analyzer of claim 5, wherein the two electrodes comprise two concentric hemispherical electrodes, an inner hemispherical electrode and an outer hemispherical electrode.

18. The analyzer of claim 17, wherein the aperture plate is spaced from the collimator plate a distance equal to about 15% of the radius of the inner hemisphere.

19. A charged particle energy analyzer comprising:

two concentric hemispherical electrodes arranged to define a space between the electrodes for passing particles having selected energies;

an aperture plate spaced from the electrodes and comprising an arcuate slit entrance aperture arranged to admit particles into the space between the electrodes; and a collimator plate spaced from the aperture plate such that the aperture plate is disposed between the collimator plate and the electrodes, the collimator plate comprising an arcuate slit entrance collimator arranged to define an angle of acceptance into the entrance aperture;

wherein the entrance aperture and entrance collimator define a solid angle of acceptance of the analyzer and the analyzer is capable of analyzing particles entering the space between the electrodes through the solid angle of acceptance.

* * * * *